US008915028B2

(12) United States Patent
Ferguson

(10) Patent No.: US 8,915,028 B2
(45) Date of Patent: Dec. 23, 2014

(54) STILT FOR ELEVATING STORAGE MEANS IN A ROOF SPACE

(76) Inventor: David Ferguson, Brighton (GB)

( * ) Notice: Subject to any disclaimer, the term of this patent is extended or adjusted under 35 U.S.C. 154(b) by 44 days.

(21) Appl. No.: 13/699,324

(22) PCT Filed: Mar. 8, 2011

(86) PCT No.: PCT/GB2011/050460

§ 371 (c)(1),
(2), (4) Date: Apr. 19, 2013

(87) PCT Pub. No.: WO2011/110848

PCT Pub. Date: Sep. 15, 2011

(65) Prior Publication Data

US 2013/0232891 A1 Sep. 12, 2013

(30) Foreign Application Priority Data

Mar. 9, 2010 (GB) ..... 1003871.9
Nov. 11, 2010 (GB) ..... 1019141.9

(51) Int. Cl.
*E04B 5/43* (2006.01)
*E04F 15/024* (2006.01)
*E04C 2/52* (2006.01)

(52) U.S. Cl.
CPC ..... *E04F 15/02458* (2013.01); *E04F 15/02452* (2013.01)
USPC ..... 52/126.5; 52/263; 52/220.8; 52/126.4

(58) Field of Classification Search
CPC ..... E04F 15/02452; E04F 15/02405; E04F 15/02435; E04F 15/024; E04F 15/02458; E04F 15/02447; E04F 15/20; E04F 15/02183; E04F 15/02476; E04F 15/0247; E04F 15/02646; E04B 5/48
USPC ..... 52/125.1, 126.1–126.7, 127.1–127.2, 52/506.03–506.04, 506.01, 220.1, 220.8
See application file for complete search history.

(56) References Cited

U.S. PATENT DOCUMENTS 3,088,025 A * 4/1963 Deaton ..... 362/354
3,616,584 A * 11/1971 Sartori et al. ..... 52/126.6
3,774,024 A * 11/1973 Deaton ..... 362/319
3,809,358 A * 5/1974 Hazeley ..... 248/317
4,074,488 A * 2/1978 Ray, III ..... 52/263
5,186,430 A * 2/1993 Ellithorpe ..... 248/354.3

(Continued)

FOREIGN PATENT DOCUMENTS

DE 202009013651 2/2010
EP 0921252 6/1999

(Continued)

OTHER PUBLICATIONS

Athina Nickitas-Etienne; International Preliminary Report on Patentability in PCT/GB2011/050460; Sep. 11, 2012; The International Bureau of WIPO.

(Continued)

*Primary Examiner* — Jeanette E Chapman
(74) *Attorney, Agent, or Firm* — Florek & Endres PLLC

(57) ABSTRACT

A roof stilt for elevating flooring in a roof space comprising: a joist receptacle; a platform for affixing flooring to the stilt; and a support column extending between the joist receptacle and the platform for supporting the weight of elevated flooring.

29 Claims, 7 Drawing Sheets

(56) References Cited

U.S. PATENT DOCUMENTS

| | | | | |
|---|---|---|---|---|
| 5,400,554 | A * | 3/1995 | Lo | 52/126.5 |
| 5,518,215 | A * | 5/1996 | Lyons | 248/309.2 |
| 5,816,554 | A | 10/1998 | McCracken et al. | |
| 6,370,831 | B1 * | 4/2002 | Marshall et al. | 52/263 |
| 7,610,728 | B1 | 11/2009 | Manocchia | |
| 8,156,694 | B2 * | 4/2012 | Knight et al. | 52/126.6 |
| 8,381,461 | B2 * | 2/2013 | Repasky | 52/126.6 |
| 2006/0192069 | A1 | 8/2006 | Attaway | |
| 2008/0000181 | A1 | 1/2008 | Sillik | |
| 2008/0134608 | A1 | 6/2008 | Snyder et al. | |

FOREIGN PATENT DOCUMENTS

| | | |
|---|---|---|
| FR | 2936536 | 4/2010 |
| GB | 2438620 | 12/2007 |
| GB | 2468674 | 9/2010 |

OTHER PUBLICATIONS

Eleanor Wade; Patent Acts 1977: Search Report under Section 17 in GB 1019141.9; Mar. 3, 2011; U.K. Intellectual Property Office.

Helen Harrop; Patents Act 1977: Examination Report under Section 18(3) in GB 1117661.7; Dec. 5, 2011; UK Intellectual Property Office.

J. Bauer; Examination Report in EP 11714812.2; Nov. 13, 2013; European Patent Office.

J. Bauer; International Search Report in PCT/GB2011/050460; Jul. 12, 2011; European Patent Office.

* cited by examiner

STILT FOR ELEVATING STORAGE MEANS IN A ROOF SPACE

This application is a U.S. National Stage filing under 35 U.S.C. §371 of International Application No. PCT/GB/2011/050460, filed Mar. 8, 2011, which in turn claims priority to British Patent Application No. 1003871.9, filed Mar. 9, 2010, and also to British Patent Application No. 1019141.9, filed Nov. 11, 2010.

TECHNICAL FIELD

The present invention relates to a stilt for elevating storage means in a roof space.

BACKGROUND OF THE INVENTION

In many buildings, loft space is often insulated to reduce heat loss. Buildings without loft insulation lose roughly one quarter of their heat through the roof. As energy prices rise and pressure to save energy increases, residential and commercial building owners are becoming ever more conscious of the importance of loft insulation for saving both energy and money. Authorities are beginning to recognise this significant wastage. The UK government, for example, offers grants of up to 100% for the installation of loft insulation.

Many building owners choose mineral wool "quilts" as insulation. To provide an adequate level of insulation, two layers of these quilts must be laid: the first layer is laid between the horizontal joists; the second layer is cross-laid on top of the first, covering the joists. This typically gives a layer of insulation 270 mm thick. In order to work effectively, nothing should be placed on top of these quilts—the quilts must not be compressed. If flooring is used to facilitate storage, such flooring compresses the insulation and if any heavy items are stored on top of the flooring the insulation is compressed further. Accordingly, present homeowners choose a compromise between insulation and storage.

Roof spaces in many buildings are used as storage spaces. Methods of maximising this space are known in the art. For example, CA2535116 to Balser discloses an attic storage system comprising rails and rollers attached to attic joists. Storage boxes are placed on these rollers and can be easily pushed around the attic space, allowing greater access to each box. However, when some or all joists are covered by the second cross-laid layer of mineral wool quilt, the utilisation of storage systems such as CA2535116 may be severely restricted or prevented.

The installation of mineral wool quilt insulation may severely restrict or, in many cases, remove entirely, space available in a loft or roof that can be used for storage. Indeed, some building owners may forego such insulation in order to maximise the space available for storage.

It can be seen by the foregoing that a need has arisen for a device to allow building owners to both insulate their lofts to an adequate degree and continue to use the lofts effectively as a storage space. It is therefore an object of the present invention to provide a device which facilitates storage above mineral wool quilt insulation whilst minimising or preventing compressing the insulation itself.

SUMMARY OF THE INVENTION

According to a first aspect of the present invention there is provided a roof stilt for elevating flooring in a roof space comprising: a joist receptacle; a platform for affixing flooring to the stilt; and a support column extending between the joist receptacle and the platform for supporting the weight of elevated flooring.

The platform is preferably substantially planar and lies in a plane perpendicular to a longest axis of the support column. Also preferably, the minimum width of the platform is greater than the maximum width of the joist receptacle, and preferably at least 50% greater than the width of the joist receptacle. The minimum width of the platform is preferably greater than the minimum width of the support column, and preferably at least 50% greater than the width of the support column. The minimum width of the joist receptacle is preferably greater than the maximum width of the support column, and is preferably at least 30% greater than the width of the support column.

The platform is configured so that flooring can be affixed on top which covers the total area of the platform. Preferably, the joist receptacle comprises a resilient clip. The platform comprises means for gripping surface configured to grip flooring in use. Optionally, the platform may comprise a rubber grip, and the means for gripping flooring comprises a textured or rubberised surface. Preferably, the platform is formed of a material that can accept fixing means such as a screw or a nail.

The joist receptacle is preferably arranged to receive joists having a width in the range of 30 mm to 60 mm, and the joist receptacle optionally defines a joist receiving channel having a width of: (i) no more than 60 mm; or (ii) between 30 and 60 mm. The joist receptacle may comprise a planar portion for engaging a planar surface of a joist, wherein the planar portion is substantially parallel to the plane of the platform. Optionally, the joist receptacle comprises an attachable grip insert. The joist receptacle may comprise an integrated grip. Preferably, the support column is an I-beam structure.

The stilt may comprise means for securing a cable, wherein the means for securing a cable are located near the platform. Preferably, one or more webs extend between the support column and the platform, to provide additional structural support. The means for securing a cable may be located on at least one web, such as in the form of a cut-out in the web. The width and length of the platform in a horizontal plane are preferably equal, and preferably the platform is circular. The stilt is preferably formed from injection moulded plastic.

In a further aspect of the invention, there is provided a roof stilt for elevating storage means in a roof space comprising: a joist securing portion for securing the stilt to joists; a supporting structure for supporting storage means on the stilt; and a support column extending between the supporting structure and securing portion.

Preferably, the support column is: (i) at least 170 mm in height; (ii) between 170 mm and 200 mm in height; or (iii) about 170 mm in height. The supporting structure is preferably substantially planar and lies in a plane perpendicular to a longest axis of the support column. The storage means are preferably supported on top of the supporting structure.

The securing portion may comprise a securing member which is arranged to be inserted into a joist, and the securing portion comprises one or more pins or one or more screws. Preferably, the securing member is integral to the stilt. Optionally, the securing portion comprises adhesive, and may further comprise a protective cover to prevent the adhesive from drying out when the stilt is not in use. The securing portion may comprise a clamp.

The supporting structure comprises gripping surface configured to grip storage means. The means for gripping flooring comprises a textured or rubberised surface.

The stilt may comprise at least one clip near the supporting structure for securing an elongate member. Preferably, the stilt comprises one or more, and preferably four, webs extending between the support column and the supporting structure. At least one clip for securing an elongate member may be located on said at least one web.

In a further aspect of the invention there is provided a kit of parts for providing a flooring system, said kit of parts comprising: a plurality of stilts as claimed in any preceding claim; and flooring. The kit of parts preferably further comprises insulation. When the stilts are secured to joists, the insulation is preferably laid between and over the joists and is thicker than the height of the joists, and when the flooring is fixed to the stilts, the stilt prevents substantial compression of the insulation by the flooring.

In yet a further aspect of the invention, there is provided a flooring system comprising: a plurality of stilts according to any of claims 1 to 28; a plurality of joists; and flooring, wherein the joists are received in the joists receptacles of the stilts and the flooring is secured to the platforms of the stilts.

A further aspect of the invention provides a flooring system comprising: a plurality of stilts preferably according to any embodiment described; a plurality of joists; and flooring, wherein the stilts are secured to the joists by the securing portion and the flooring is secured to the supporting means of the stilts. Preferably, the system further comprises insulation located between the joists.

A yet further aspect of the invention provides a method of using the stilt, kit of parts or system described to elevate a floor in a roof space.

Accordingly, there is provided a method of elevating a floor accommodating insulation in a roof space comprising: inserting insulation in the roof space, wherein the resulting total thickness of the insulation, including any pre-existing insulation between joists, when laid exceeds the height of the joists, and some insulation, whether pre-existing or inserted, is between the joists; securing a plurality of stilts, preferably according to any of claims 1 to 28, to one or more of the joists; placing flooring on the tops of the stilts and over the insulation, such as the platforms of the stilts, so that the flooring is supported by the stilts.

The flooring is preferably secured to the platforms of the stilts. Preferably, a first layer of insulation is laid between the joists and a second layer of insulation is cross-laid over the first layer, and wherein the second layer of insulation substantially covers the joists. Preferably, the plurality of stilts are positioned such that the distance from the lower horizontal surface of a joist to the top surface of a stilt when secured to a joist is approximately the same as the thickness of the insulation, so that the top of the insulation is proximal to the platforms. Preferably, each of the plurality of stilts resides within a layer of insulation when secured to a joist. Preferably, the step of securing flooring to said platforms does not compress the insulation positioned between the joists. The step of securing may include securing at least four stilts to at least two joists so that the at least four stilts define corners of a polygon, and wherein the step of placing flooring comprises placing flooring to completely cover the area of the polygon. The flooring may be secured together by clips.

BRIEF DESCRIPTION OF THE DRAWINGS

Some preferred embodiments of the present invention will now be described by way of example only and with reference to FIGS. 1 to 8 of which.

DETAILED DESCRIPTION OF THE PREFERRED EMBODIMENTS

Figures 1, 2, 3:
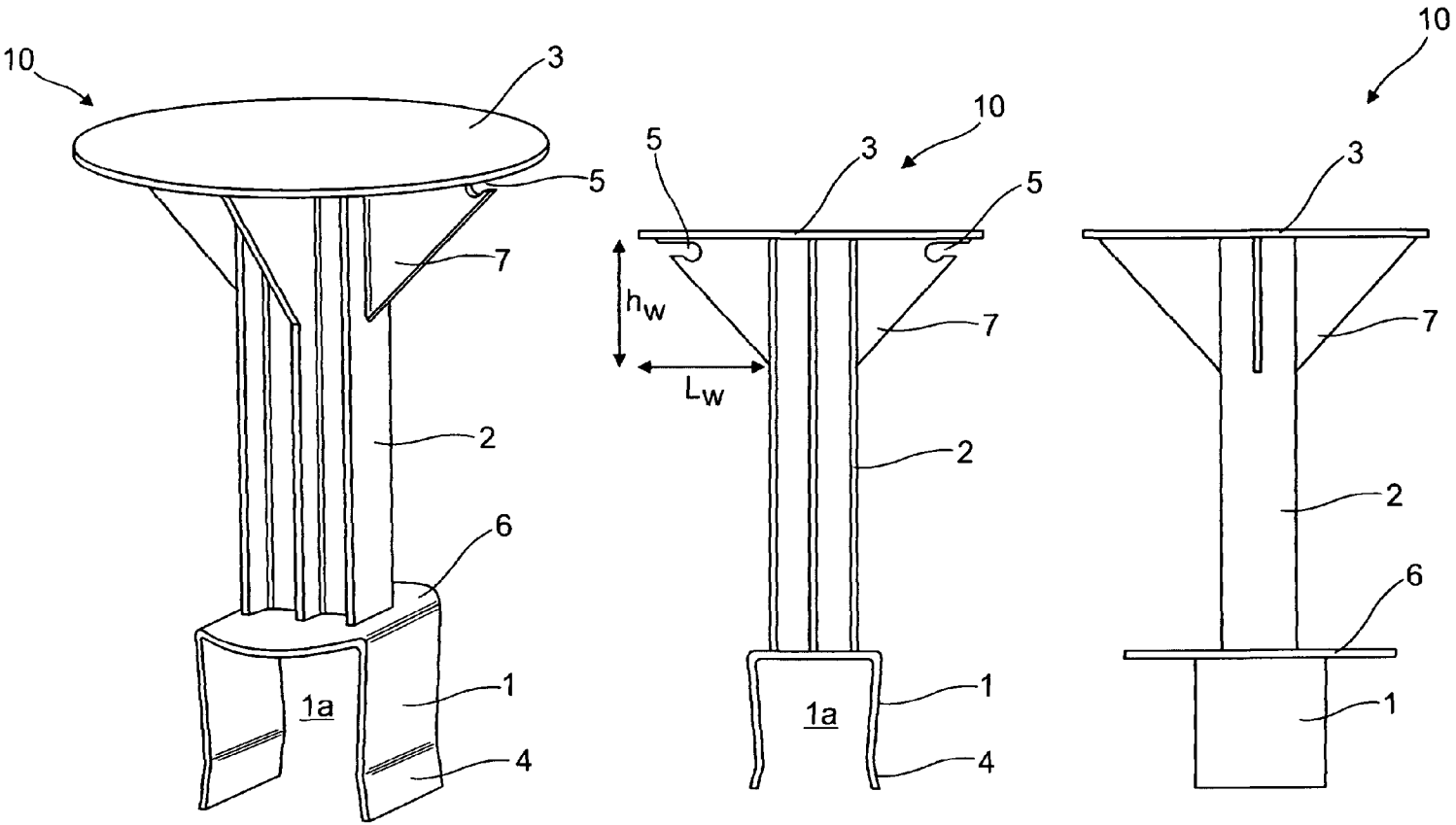
FIG. 1 is a perspective view of a stilt according to an embodiment of the present invention.
FIG. 2 is a front view of the stilt of FIG. 1.
FIG. 3 is a side view of the stilt of FIG. 1.

FIGS. 1 to 3 show a stilt 10 having a securing portion 1, a support column 2 and a supporting structure 3. In the embodiments shown, the supporting structure 3 is a platform and the securing portion 1 is a joist receptacle. The support column 2 extends between the joist receptacle 1 and the platform 3, such that the platform 3 and the joist receptacle 1 are located at opposite ends of the stilt. A planar portion 6 is located between the support column 2 and joist receptacle 1. The platform 3 comprises a planar upper surface to allow flooring to be secured to the stilt. The stilt 10 is formed by injection moulding a plastics material.

The joist receptacle 1 defines a joist receiving channel 1*a*. The joist receiving channel may have a width of: (i) no more than 60 mm; or (ii) between 30 and 60 mm. The width refers to the width of the channel at its narrowest point in its normal state when not engaging or receiving a joist. The joist receptacle 1 comprises a resilient clip 4 which allows the joist receptacle 1 to receive and engage joists. The substantially vertical portions of the joist receptacle 1 are slightly bent to form clip 4 help the ease at which joists are received in the joist receptacle. The clip 4 provides an easy and convenient way of securing the stilt 10 on the joist and allows the stilt 10 to be secured to joists of varying widths within a range. The joists may be of widths within the range of 30 mm to 60 mm. Typically, joists have a width of 50 mm. The lower portions of clip 4 can be urged apart sufficiently to allow a joist to be inserted into channel 1*a*. The flexibility of the clip 4 allows a single stilt to be secured to joists of varying widths. It will be appreciated that stilts according to embodiments of the invention may have clips which vary in width to accommodate different widths of joist.

The joist receptacle 1 comprises a planar portion 6, which is substantially oval in shape. In some embodiments, the planar portion 6 may be rectangular in shape. The planar portion 6 extends laterally, beyond the cross-section of the support column 2, along a horizontal axis defined by the channel 1*a*. In use, the lateral extension of the planar portion 6 will contact the top surface of a joist. The width of the planar portion 6 (i.e. its dimension in a horizontal axis at 90 degrees to the axis defined by channel 1*a*) does not exceed the maximum width of the channel 1*a*. In some embodiments, the planar portion includes apertures through which fixing means such as nails or screws can extend through to securely fix the stilt 10 to the joist in addition to the clip 4.

It will be appreciated that considerable weight may be placed on the flooring attached to the platform 3 of the stilt 10 when the stilt 10 is fitted to a joist in use. This weight must be adequately supported by the platform 3 and support column 2. The stilt 10 is formed from injection moulded plastic, and the support column 2 is solid and rigid to provide sufficient support. The support column 2 may have an I-shaped cross section, and is preferably an I-beam structure. This provides a high strength column while minimising its volume (thereby maximising space for insulation) and the materials used. As can be seen from FIG. 6, the support column is orientated relative to the joist receptacle 1 such that the length of the central 'I' section lies perpendicularly to the axis defined by channel 1*a* (and therefore the direction of the longest length of a ceiling joist). It will be appreciated by those skilled in the art that the 'I' beam support column will be more stable in a horizontal axis parallel to the length of the central 'I' section. Flooring panels are typically laid such that their longest axis is perpendicular to the longest length of a joist, and consequently there is more likely to be a moment about a horizontal axis in a plane defined the longest length of a flooring panels. As can also be seen in FIG. 6, the support column 2 also has a central flange extending perpendicularly from the central 'I' section (i.e. in the same axis as defined by channel 1*a*). This central flange is an extension of two opposite webs and provides additional strength.

The maximum width of the support column 2 is less than the width of the joist receiving channel 1*a*. The maximum width of the support column 2 is preferably minimised in order to minimise the volume taken up by the stilt 10 (which would otherwise be volume occupied by insulation) and therefore minimise lateral compression of the insulation. The support column 2 defines a central axis around which the platform 3 and planar platform 6 of the joist receptacle 4 is centred.

The length of the support column 2 is approximately 170 mm. A first layer of insulation is usually laid in one direction to lie between the joists, and then a second layer is cross-laid on top of the first layer. Once laid, the first layer will have a thickness of approximately 100 mm and the second will have a thickness of approximately 170 mm. These two layers together will therefore be approximately 270 mm thick. Typical joists are approximately 100 mm in height. The second layer will cover the top of the joists. In use, therefore, the stilt will reside within the second layer of insulation.

Figure 5:
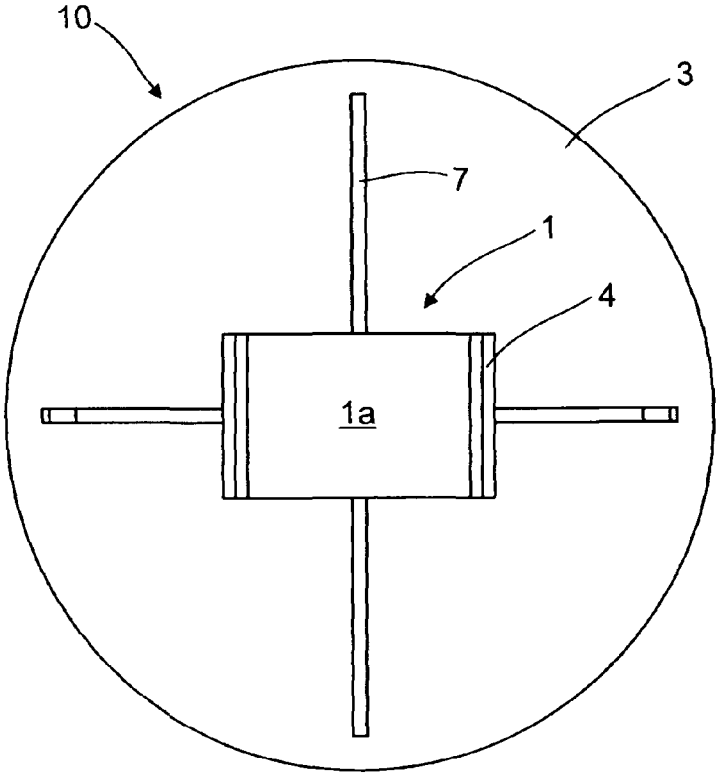
FIG. 5 is an underside view of the stilt of FIG. 1.
Figure 4:
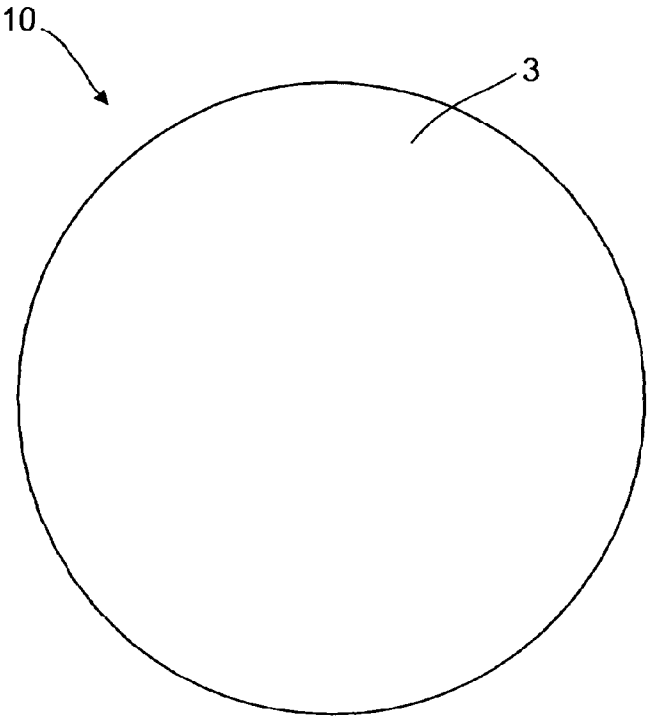
FIG. 4 is an plan view of the stilt of FIG. 1.

FIG. 4 is a plan view of the platform 3 of the stilt 10. FIG. 5 is an underside view of the stilt 10. The support column 2 is joined at its opposite end to the platform 3.

The platform 3 may be circular, to provide a relatively large surface area without using excessive material. Alternatively, it may be any shape suitable to support flooring, such as square, circular, rectangular, oval, 'cross'-shaped, etc. It will be appreciated by those skilled in the art that the surface area of the platform 3 should be sufficient to provide an adequate area on which flooring can be easily affixed without comprising the stability of the stilt. The platform 3 provides a surface onto which flooring may be affixed and/or supported. The platform may be any suitable shape that provides a surface area sufficient to allow flooring to be suitably attached to it. In FIG. 4 the platform is circular and has a minimum diameter of approximately 150 mm. Importantly, the platform 3 has a diameter or maximum width greater than the width of a joist, the maximum width of the channel 1*a*, the maximum length of planar portion 6, the maximum length of joist receptacle 1 and the maximum width of the support column 2 in order to provide a stilt to which flooring can be applied and supported, but is stable and does not use too much material and occupy too much volume in an insulated area.

The stilt 10 comprises four webs 7. Each web is substantially triangular. As can be seen from FIG. 2, the distance $h_w$ is at least 25% of the length of support column 2, and the distance $W_w$ is at least 25% of the width maximum width or diameter of platform 3. The webs provide additional structural support to enable the platform and support column to support heavy loads. As shown in FIG. 1, the webs are substantially planar and extend between the support column 2 and the platform 3 such that a moment caused by a force applied on the platform does not substantially compromise the stability of the stilt 10 about a horizontal axis. The webs provide structural support between the platform and the support column so that load can be supported on a surface area of the platform which is significantly larger that the cross section of the support column. On two opposed webs 7, there are formed clips 5 for holding an elongate member such as a wire, cable or dust sheet. The webs 7 also provide an additional thickness through which to insert one or more fixing means such as nails or screws which affix flooring to the platform 3. In some embodiments, the top side of the platform 3 may provide indications such as marks or indentations to indicate the location of the webs as they extend from the underside of the platform 3.

Figure 6:
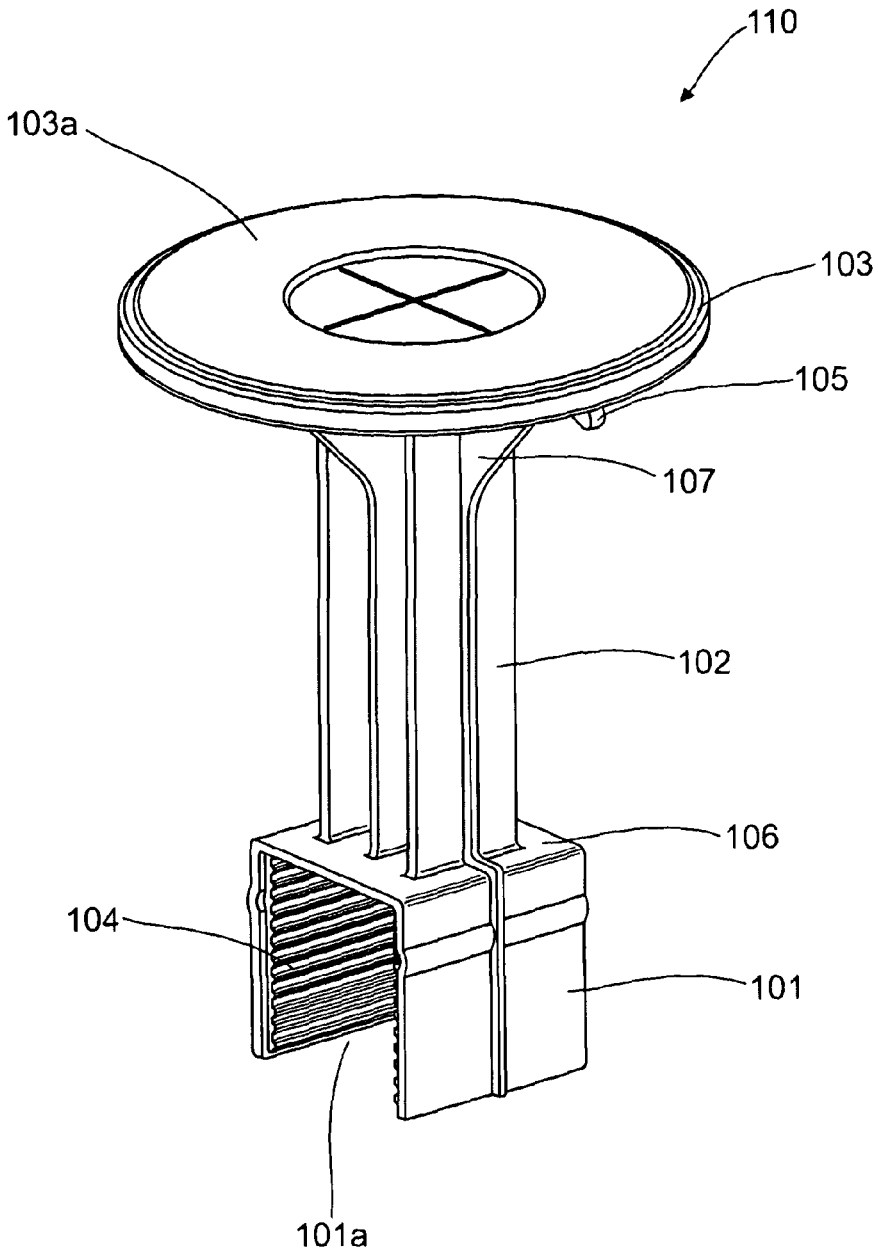
FIG. 6 is a perspective view of a stilt according to a second embodiment of the present invention.

A second embodiment of the invention is shown in FIG. 6. Here, stilt 110 comprises joist receptacle 101, support column 102, platform 103 for affixing flooring means, webs 107 and a clip 105 in accordance with earlier embodiments. The platform 103 of stilt 110 additionally comprises a circular integrated grip 103*a* to facilitate the fixing of flooring to the platform 103. The integrated grip 103*a* comprises a rubber material. Flooring is laid on top of the stilts prior to securing the flooring to the stilts. The integrated grip 103*a* facilitates frictional engagement of the flooring with the platform 103, thereby to prevent flooring slipping on the platform 3 when securing the flooring. The integrated grip 103*a* enables accurate positioning and fixing of the flooring to the stilts. In an further embodiment, the platform 103 may comprise adhesive on its top side to affix flooring panels to the stilts 110. Prior to use, the adhesive area may be covered by a protective layer to prevent the adhesive from drying out.

The joist receptacle 101 additionally comprises a grip insert 104. In this embodiment, the grip insert 104 defines joist receiving channel 101*a*. As the thickness of joists can vary, a plurality of interchangeable or grip inserts 104 in a range of sizes can be provided to ensure that the stilt can be used on joists of different widths. The grip insert 104 may be snap-fit attachable into the joist receptacle 101. The grip insert 104 comprises a rubberised or textured material to maximise grip on the joists and preferably comprises rubber. Insert 104 is shaped such that it may be slotted on to joists 201 (see FIG. 7). As before, the joist receiving channel 101*a* is rectangular in shape, to match the shape of the joist 201.

Figure 7:
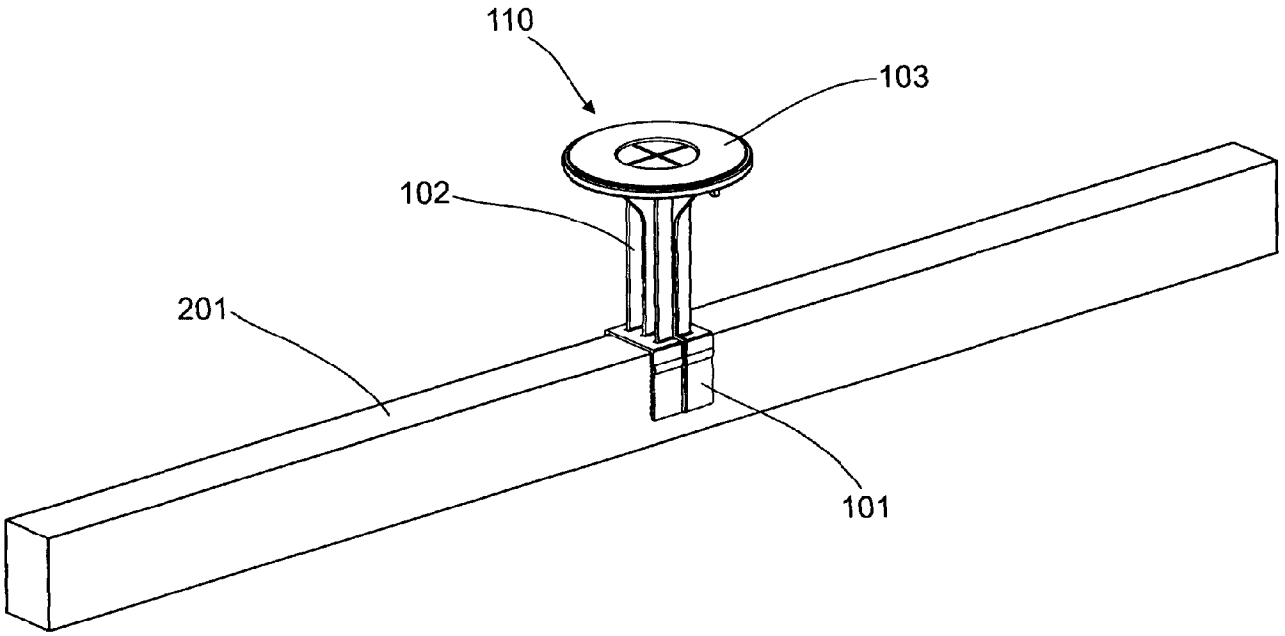
FIG. 7 is a perspective view of the stilt having securing means of FIG. 6 fitted on a joist.
Figure 8:
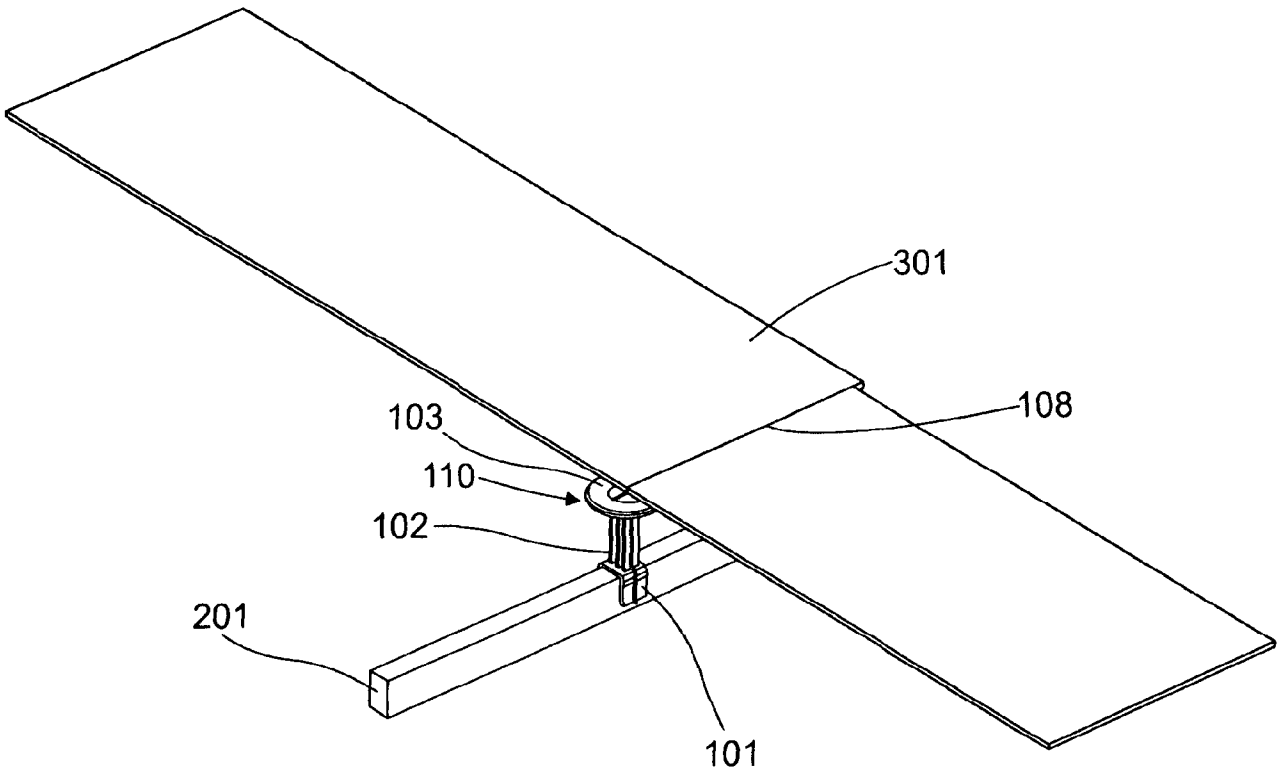
FIG. 8 is a perspective view of the stilt and joist of FIG. 7, with a level of flooring for storage in place on top of the stilt.

FIG. 7 shows a stilt 110 attached to a joist 201. A layer of insulation (not shown) may lie across the joist 201 in the same direction as the floor panel 301 as shown in FIG. 8. Often, a plurality of stilts 10, 110 may be located on a single joist between sections of cross-laid insulation. However, it may be necessary, in order to place the stilts in specific positions, to insert stilts 10, 110 through a layer of insulation to contact the joist 201 by tearing a hole in the insulation. As shown in FIG. 8, flooring in the form of floor panels 301 is secured to the platform 103 of the stilts 110 such that the length of a floor panel is at 90 degrees to the length of a joist. One or more securing members (not shown) such as nails or screws are passed through the floor panels 301 into the platforms 103. Any insulation (not shown) lying between and over the joists will be located below the flooring panels 301 without being compressed. In some embodiments, platform 103 may comprise a series of apertures to receive screws, and the flooring may be secured to a stilts 110 by screwing screws into apertures in the platform 103.

Figure 9:
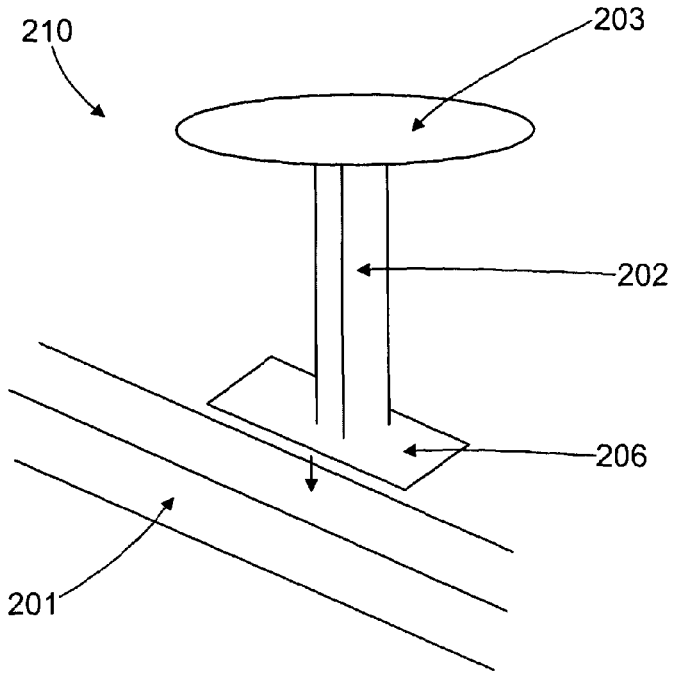
FIG. 9 is a perspective view of a stilt according to a third embodiment of the invention.

A third embodiment of the invention is shown in FIG. 9. Stilt 210 comprises a platform 203, support column 202 and planar portion 206. The stilt 210 is secured to joist 201 by adhesive located on the underside of the stilt 201. Prior to use, the adhesive is covered by a removable label to prevent the adhesive from drying out. The label is removed immediately prior to securing the stilt to the joist.

Figure 10A:
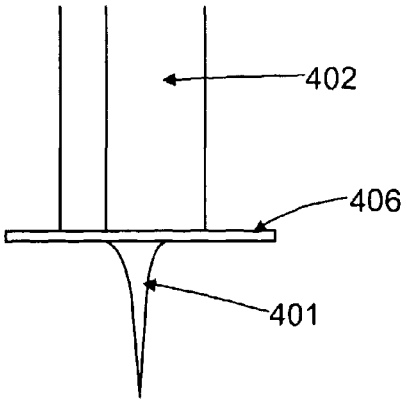
FIG. 10*a* is a partial side view of a stilt having securing means according to a fourth embodiment of the invention.
Figure 10B:
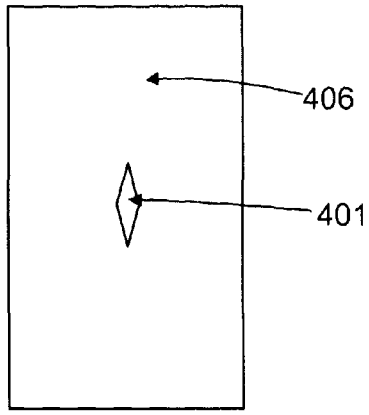
FIG. 10*b* is a view of the underside of the securing means according to FIG. 10*a;*
Figure 11A:
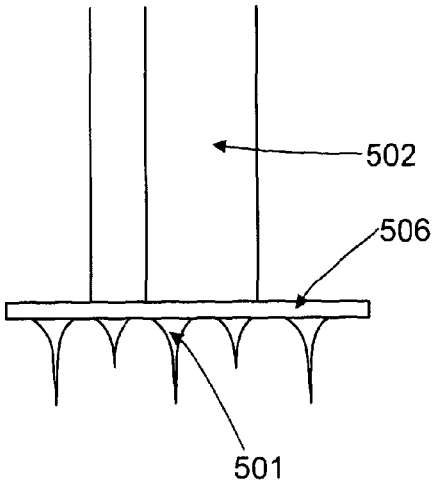
FIG. 11*a* is a partial side view of a stilt having securing means according to a fifth embodiment of the invention.
Figure 11B:
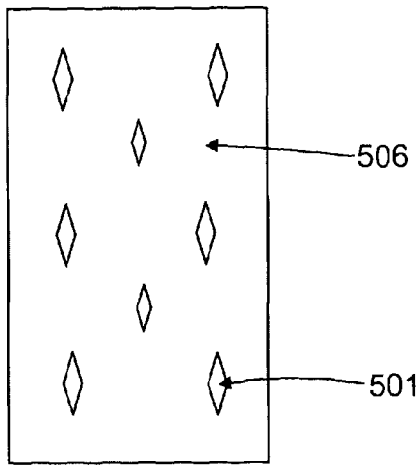
FIG. 11*b* is a view of the underside of the securing means according to FIG. 10*a;*
Figure 12A:
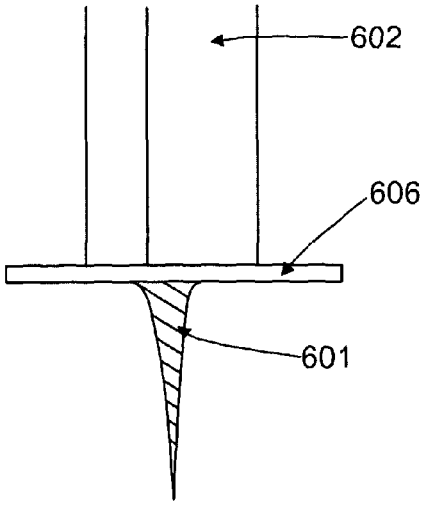
FIG. 12*a* is a partial side view of a stilt having securing means according to a sixth embodiment of the invention.
Figure 12B:
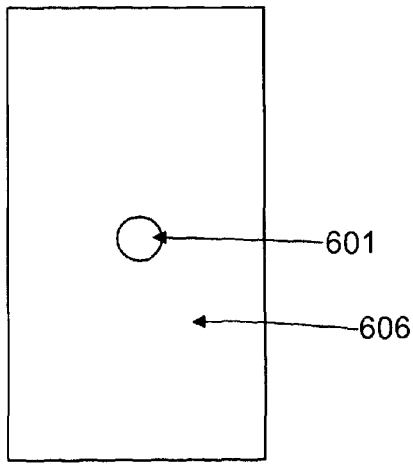
FIG. 12*b* is a view of the underside of the securing means according to FIG. 10*a.*

FIGS. 10*a* and 10*b* show a fourth embodiment of the invention. Here, a pin 401 extends from the underside of planar portion 406. The stilt may be pushed or hammered into the joist such that the nail or pin 401 extends into the joist. The pin or nail 401 is integral with the stilt. In a fifth embodiment of the invention, a plurality of pins 501 extend from the underside of planar portion 506, as shown in FIGS. 11*a* and 11*b*. FIG. 11*b* shows the arrangement of nails or pins of different lengths and widths on the underside of planar portion 506. The stilt may be pushed or hammered into the joist such that each nail or pin 501 extends into the joist. Each pin or nail 501 is integral with the stilt. In a sixth embodiment of the invention, a screw 601 extends from planar portion 606, as shown in FIGS. 12*a* and 12*b*. The screw 601 is integral to the stilt. To secure the stilt to a joist, the stilt is rotated such that the screw extends into the joist. In a further embodiments of the invention, the securing means may comprise a clamp.

In use, the stilt is secured to ceiling joists after insulation has been laid between the joists. The distance between joists varies according to the building but is usually between 400 mm and 600 mm and is typically 400 mm or 600 mm. Rolls of insulation have a typical width of 400 mm or 600 mm, and therefore a first layer of insulation may be laid in the space between joists. As described above, a second layer is typically laid in a direction at 90 degrees to the first layer. A plurality of stilts are typically positioned at points along a joist where two sections of the second layer of insulation meet, but may also be positioned at any point along a joist (such that the stilt is inserted through a section of the second layer of insulation).

Flooring is then laid on top of the stilts, such that the platform supports the flooring. It will be appreciated by those skilled in the art that flooring may not necessarily cover all of the roof space, and therefore the stilts may be fitted on specific joists as required. The stilts will ideally be placed where flooring panels meet. For example, a stilt may be placed where the corners of four different flooring panels meet, and/or where the edges of two panels meet, as shown by reference 108 in FIG. 8. Typically, 10-15 stilts are required for flooring covering 2.5 $m^2$. A stilt may also be placed in other locations under a single flooring panel for support. The flooring panels themselves may be clipped together by methods known to those skilled in the art. In such cases, some stilts may not be secured to the panels, but may simply support them. Once fitted, the flooring completely covers the platforms such that the stilt does not extend above the flooring.

An advantage of the stilt according to the embodiments described is that it allows users to easily erect a level of flooring above insulation (such as mineral wool quilt insulation) that is thicker than the height of the joists. In other words, where the insulation extends above the joists, the stilt allows a floor to be erected above the insulation and joists without compressing the insulation (e.g. the quilts). The stilt enables flooring to be installed above insulation in order to allow thick insulation to be used in a roof space. The term 'elevated flooring' should be understood to mean a floor spaced above the top surface of the joists. In any of the embodiments described, the platform may be any means suitable for supporting or affixing flooring to the stilt. Stilts having a support column of at least 170 mm allow a floor to be erected above insulation of 270 mm thickness laid between joists 100 mm in height. The stilts elevate flooring above insulation such that the flooring can still be used as a storage means without compressing the insulation. A further advantage is that it may be installed quickly and easily, with little expertise required The present invention in accordance with these further aspects of the invention may include any or all of the features described in respect of the other aspects and embodiments of the invention to the extent that they are not mutually inconsistent therewith.

The invention claimed is:

1. A roof stilt for elevating flooring in a roof space comprising:

a joist receptacle;

a platform for affixing flooring to the stilt;

a support column extending between the joist receptacle and the platform for supporting the weight of elevated flooring, wherein the joist receptacle, platform, and support column are integrally formed; and one or more planar webs extending between the support column and the platform, wherein the one or more webs provide additional structural support, and wherein the means for securing a cable is located on a web of the one or more planar webs.

2. The stilt of claim 1, wherein the platform is substantially planar and lies in a plane perpendicular to a longest axis of the support column.

3. The stilt of claim 1, wherein the platform's minimum width is greater than the joist receptacle's maximum width.

4. The stilt of claim 1, wherein the platform's minimum width is greater than the support column's minimum width.

5. The stilt of claim 1, wherein the joist receptacle's minimum width is greater than the support column's maximum width.

6. The stilt of claim 1, wherein the flooring is affixed on top of the platform, wherein said flooring covers the platform's total area.

7. The stilt of claim 1, wherein the joist receptacle comprises a resilient clip.

8. The stilt of claim 1, wherein the platform comprises means for gripping surface configured to grip flooring in use.

9. The stilt of claim 8, wherein the means for gripping flooring comprises a textured or rubberised surface.

10. The stilt of claim 1, wherein the platform is formed of a material that can accept fixing means.

11. The stilt of claim 1, wherein the joist receptacle is arranged to receive joists having a width of 30 mm to 60 mm.

12. The stilt of claim 1, wherein the joist receptacle defines a joist receiving channel having a width of:

(i) no more than 60 mm; or (ii) between 30 and 60 mm.

13. The stilt of claim 1, wherein the joist receptacle comprises a planar portion for engaging a planar surface of a joist, wherein the planar portion is substantially parallel to the plane of the platform.

14. The stilt of claim 1, where the support column is an I-beam structure.

15. The stilt of claim 1, where the stilt further comprises means for securing a cable, wherein the means for securing a cable are located near the platform.

16. The stilt of claim 1, wherein the platform's width and length are equal in a horizontal plane.

17. The stilt of claim 1, wherein the stilt is formed from injection moulded plastic.

18. The stilt of claim 1, further comprising at least one attachable grip insert to alter a width of the joist receptacle.

19. A roof stilt for elevating storage means in a roof space comprising:

a joist securing portion for securing the stilt to joists;

a supporting structure for supporting storage means on the stilt;

a support column extending between the supporting structure and securing portion, wherein the joist securing portion, supporting structure, and support column are integrally formed;

at least one clip near the supporting structure for securing an elongate member; and one or more webs extending between the support column and the supporting structure, wherein a clip of the at least one clip for securing an elongate member is located on a web of said at least one web.

20. The roof stilt of claim 19, wherein said support column is of a height selected from the group consisting of:

(i) at least 170 mm in height;

(ii) between 170 mm and 200 mm in height; and (iii) about 170 mm in height.

21. The roof stilt of claim 19, wherein said supporting structure is substantially planar and lies in a plane perpendicular to a longest axis of the support column.

22. The roof stilt of claim 19, wherein storage means is supported on top of the supporting structure.

23. The roof stilt of claim 19, further comprising attachable grip insert to alter a width of the joist securing portion.

24. The roof stilt of claim 19, wherein the securing portion is integral to the stilt.

25. The roof stilt of claim 23, wherein said securing portion comprises adhesive and further comprising a protective cover over the adhesive.

26. The roof stilt of claim 19, wherein said supporting structure comprises gripping surface configured to grip storage means.

27. The stilt of claim 26, wherein the means for gripping flooring comprises a textured or rubberised surface.

28. The stilt of claim 19, wherein the stilt comprises four webs.

29. A method of elevating a floor accommodating insulation in a roof space comprising:

inserting insulation in the roof space, wherein the resulting total thickness of the insulation, including any pre-existing insulation between joists, when laid exceeds the height of the joists, and some insulation, whether pre-existing or inserted, is between the joists;

securing a plurality of stilts to one or more of the joists; and placing flooring on the tops of the stilts and over the insulation so that the flooring is supported by the stilts, wherein the roof stilt is for elevating flooring in a roof space comprising:

a joist receptacle; a platform for affixing flooring to the stilt; and a support column extending between the joist receptacle and the platform for supporting the weight of elevated flooring.

* * * * *